US005320355A

United States Patent [19]

Johnson

[11] Patent Number: 5,320,355

[45] Date of Patent: Jun. 14, 1994

[54] PUTTING GUIDE

[76] Inventor: Christopher J. Johnson, 19815 Gary St. NW, Elk River, Minn. 55330

[21] Appl. No.: 59,771

[22] Filed: May 10, 1993

[51] Int. Cl.[5] ..... A63B 69/36

[52] U.S. Cl. ..... 273/192; 273/187 R; 403/392; 403/297

[58] Field of Search ..... 273/187 R, 192, 186.1, 273/187.1, 187.6, 191 R, 191 B, 195 R; 446/119, 486, 487, 278, 488; 403/297, 220, 392

[56] References Cited

U.S. PATENT DOCUMENTS

| | | | |
|---|---|---|---|
| 2,894,755 | 7/1959 | Scelzo, Jr. | 273/192 |
| 3,868,116 | 2/1975 | Ford et al. | 273/192 |
| 4,423,875 | 1/1984 | Miller | 273/192 |
| 4,516,779 | 5/1985 | Miller | 273/186.1 |
| 4,544,160 | 10/1985 | Miner | 273/186 |
| 4,620,708 | 11/1986 | Meyer et al. | 273/192 |
| 4,984,802 | 1/1991 | Barraclough | 273/192 |
| 5,011,154 | 4/1991 | Bowen | 273/192 |
| 5,014,994 | 5/1991 | Peters | 273/192 |

*Primary Examiner*—Mark S. Graham

[57] ABSTRACT

A putter guide is provided for guiding a putter blade during a putting stroke. A first elongate member has a first end and a second end. The second end has an aperture extending into the second end. A second elongate member also has a first and second end. The second end of the second elongate member also has an aperture extending into the second end. A unitary accordion member has a first end and a second end. Each end has a protruding knuckle sized to be frictionally fit into the apertures of the second ends of the first and second elongate members. The accordion member is collapsible and extendable to vary the distance between the second ends of the first and second elongate members.

11 Claims, 1 Drawing Sheet

PUTTING GUIDE

BACKGROUND OF THE INVENTION

The present invention deals with golf. More particularly, the present invention deals with a guiding apparatus for guiding a putter blade through a putting stroke.

Putting is a very important component in the game of golf. In order to establish a desirable putting stroke, it is required that the blade of the putter be brought straight back, and straight forward, through the ball, finishing toward the target. It is also very important in a good putting stroke that the golfer's head be held very still, in a fixed position, with the golfer's eyes either looking at the golf ball being struck, or at a point slightly forward of the golf ball.

Therefore, it is difficult when putting (even when only practicing) to determine whether the blade of the putter is going straight back, and finishing straight through the ball toward the hole (or the target). If the golfer's head moves to watch the putter blade during the stroke, the rest of the putting stroke can be affected. Thus, even if the putter blade is going straight back when the golfer is watching it, the blade may not be going straight back and coming straight forward when the golfer is actually looking at the golf ball and exercising the normal putting stroke.

Muscle memory also plays a large part in developing a good putting stroke. It is widely believed that, through hours of practice, muscles can actually be taught to reliably repeat the same stroke. Therefore, by practicing a mechanically sound putting stroke, the golfer can obtain consistency in the putting stroke to become a better overall golfer.

There are prior systems which assist in achieving muscle memory for putting. However, these systems are often very cumbersome, having four or more pieces. In addition, some systems have rigid set-ups which are bulky and not easily carried in a golf bag.

Thus, there is a continuing need for improved devices which can be used while practicing putting to develop a good putting stroke, and which can be easily assembled, disassembled and stored in a golf bag.

SUMMARY OF THE INVENTION

The present invention is a putter guide for guiding a putter blade during a putting stroke. A first elongate member has a first end and a second end. The second end defines an aperture extended therein. A second elongate member has a first end and a second end. The second end defines an aperture therein. A unitary accordion member has a first end and a second end. Each end of the accordion member has a protruding knuckle sized to frictionally fit into the apertures of the second ends of the first and second elongate members. The accordion member is collapsible and extendable to vary the distance between the second ends of the first and second elongate members.

DETAILED DESCRIPTION OF THE PREFERRED EMBODIMENTS

Figure 1:
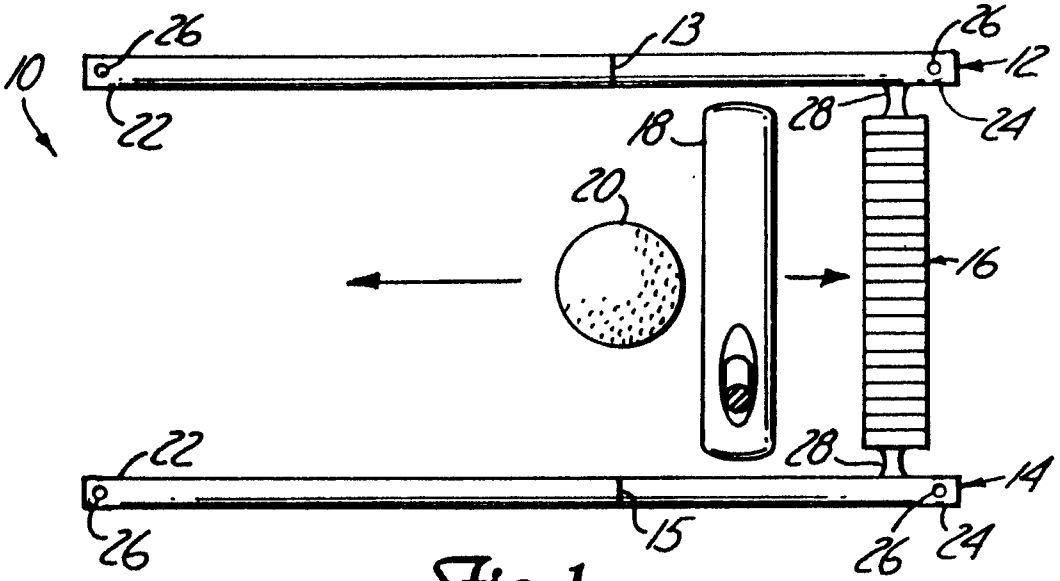
FIG. 1 is a top view of a putter guide of the present invention.

FIG. 1 is a top view of putter guide 10 of the present invention. Putter guide 10 includes first elongate member 12, second elongate member 14, and collapsible cross-member 16. Putter guide 10 is shown disposed about a putter blade 18 and a golf ball 20.

First and second elongate members 12 and 14, in this preferred embodiment, are blow-molded tubular polyethylene members. Elongate members 12 and 14 are preferably approximately 24 inches in length.

Each of elongate members 12 and 14 have first ends 22 and second ends 24. First and second ends 22 and 24 each have an aperture 26 extending from the top of the associated elongate member through the entire width of the elongate member. Apertures 26 are sized to permit a peg to be driven through apertures 26 and into a putting green so that elongate members 12 and 14 may be secured in place during use.

In one preferred embodiment, apertures 26 are sized to receive one end of a golf tee, but to preclude passage of the entire golf tee all the way through the aperture. In this way, a golf tee can be driven down into the putting green through apertures 26 and snugly secure elongate members 12 and 14 to the green so that they do not move during use.

Elongate members 12 and 14 each have a second aperture in their second ends 24. This second aperture is used in conjunction with member 16.

Collapsible cross-member 16, in this preferred embodiment, is a blow-molded polyethylene tubular accordion piece. Cross-member 16 has a knuckle 28 extending from each end thereof. The knuckle is sized so that it can be pressed into the second aperture in the ends 24 of elongate members 12 and 14. In this way, cross-member 16 holds elongate members 12 and 14 in spaced relation to one another for ease of configuration during use.

Once putter guide 10 is secured in position, golf ball 20 is placed between elongate members 12 and 14. Elongate members 12 and 14 have indicia 13 and 15 placed on them. Indicia 13 and 15 are generally aligned with one another when putter guide 10 is configured. Indicia 13 and 15 provide a marking so that ball 20 can be repeatedly placed within guide 10 in approximately the same position relative to cross-member 16. In this embodiment, indicia 13 and 15 are located approximately 15 inches from cross-member 16.

Cross-member 16 is lengthened (or collapsed) to a length which accommodates the length of putter blade 18. Elongate members 12 and 14 then guide the linear motion of putter blade 18 straight back and straight through ball 20 towards a designated target.

Figure 2:
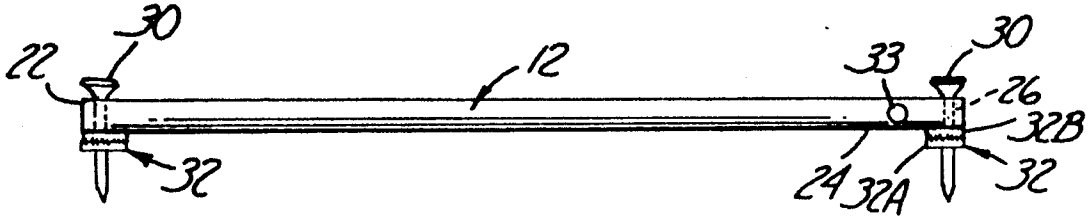
FIG. 2 is a side view of one elongate member of the putter guide shown in FIG. 1.

FIG. 2 is a side view of elongate member 12. FIG. 2 shows golf tees 30 inserted within apertures 26. Golf tees 30 can be driven into a putting green to secure elongate member 12 in place.

FIG. 2 also shows hook and loop fabric 32 secured to the first side 22, and second side 24 of elongate member 12. Hook and loop fabric 32 includes portions 32A and 32B. Portion 32B is the hook portion and portion 32A is a corresponding loop portion. Therefore, when portions 32A and 32B are placed adjacent one another, they adhere to one another in a known manner. However, when putting guide 10 is being used on carpeting, loop portion 32A is removed from the hook and loop fabric. This exposes the hook portion 32B to the carpeting. The hook portion secures itself, in a known manner, to the carpeting, thereby securing elongate member 12 in place on the carpeting.

When putter guide 10 is used on carpeting, golf tees 30 are removed and are no longer needed. However, hook and loop fabric portions 32 each have an aperture, generally aligned with apertures 26. In this way, the hook and loop portions 32 can be left in place even while putter guide 10 is used on a putting green. The tees 30 are simply inserted through the apertures 26, and through the apertures in hook and loop fabric 32 which are aligned with apertures 26. Thus, putter guide 10 is easily adaptable for indoor or outdoor use.

FIG. 2 also shows an aperture 33 in a second end 24 of elongate member 12. Aperture 33 has a diameter which is slightly smaller than the diameter of the largest portion of knuckles 28 in collapsible cross-member 16. The polyethylene material of cross-member 16 is slightly compressible so that knuckles 28 may be inserted into the apertures 33 in ends 24 of elongate members 12 and 14. In this way, knuckles 28 can be forcibly inserted into, and removed from, aperture 33 to connect and disconnect cross-member 16 with elongate member 12.

Figure 3:
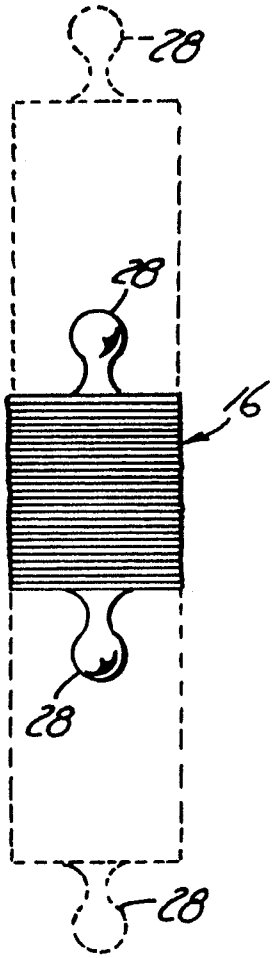
FIG. 3 is an enlarged view of a collapsible cross-member of the putter guide shown in FIG. 1.

FIG. 3 is an enlarged view of collapsible cross-member 16. FIG. 3 shows cross-member 16 in its fully collapsed position. Cross-member 16 is preferably approximately three inches long in its fully collapsed position.

FIG. 3 also shows cross-member 16 in its fully extended position, in phantom. In this preferred embodiment, cross-member 16 is approximately ten to twelve inches long in its fully extended position. Since cross-member 16 is of accordion construction, it can be easily extended by simply pulling on knuckles 28. Cross-member 16 can be collapsed by pressing knuckles 28 together in a known manner.

In conclusion, the present invention provides a very lightweight, easily portable putting guide which is also very easy to assemble and disassemble. Unlike prior art structures, which have a bulky frame, and which are made of heavier material, the present invention can easily fit into a golf bag and be carried with little extra effort. In addition, the present invention has means for securing the elongate members 12 and 14 to a putting surface, whether that surface is carpeting or grass. Thus, the present invention provides a mechanism for achieving optimal muscle memory and improving a putting stroke.

Although the present invention has been described with reference to preferred embodiments, workers skilled in the art will recognize that changes may be made in form and detail without departing from the spirit and scope of the invention.

What is claimed is:

1. A putter guide for guiding a putter blade during a putting stroke, comprising:
   - a first elongate member having a first end and a second end, the second end having an aperture extending into the second end;
   - a second elongate member having a first end and a second end, the second member second end having an aperture extending into the second end; and
   - a unitary accordion member having a first end and a second end, each accordion member end having a protruding knuckle sized to be frictionally fit into the apertures of the second ends of the first and second elongate members, the accordion member being collapsible and extendable to vary the distance between the second ends of the first and second elongate members.

2. The putter guide of claim 1 and further comprising:
   - fastening means, disposed generally at the first and second ends of the first and second elongate members to fasten the elongate members in place generally parallel to one another and connected by the unitary accordion member.

3. The putter guide of claim 2 wherein the fastening means comprises:
   - fabric fastening means for fastening the first and second elongate members to carpeting.

4. The putter guide of claim 3 wherein the fabric fastening means comprises:
   - hook and loop fastening material.

5. The putter guide of claim 2 wherein the fastening means comprises:
   - pegs sized to fit through apertures formed in the first and second ends of the first and second elongate members and to be driven into a putting green.

6. The putter guide of claim 5 wherein the pegs comprise:
   - golf tees.

7. An apparatus for use in putting a golf ball, the apparatus, comprising:
   - a first elongate tubular member having a first end and a second end, the second end having a first aperture extending therein;
   - a second elongate tubular member, generally parallel to the first elongate tubular member, having a first end and a second end, the second member second end having a first aperture extending therein; and
   - a unitary accordion member having a first end and a second end, each accordion member end having a protruding knuckle sized to be frictionally fit into the first apertures of the second ends of the first and second elongate members to hold the second ends of the first and second elongate members in spaced relation to one another, the accordion member being collapsible and extendable to vary the distance between the second ends of the first and second elongate members.

8. The apparatus of claim 7 wherein the first and second elongate members have second apertures disposed in the first ends thereof, and third apertures disposed in the second ends thereof, the second and third apertures being sized to receive a peg driven therethrough and into a putting green to anchor the first and second elongate members in place.

9. The apparatus of claim 8 and further comprising:
   - hook and loop fabric disposed at the first and second ends of the first and second elongate members located to anchor the first and second elongate members to carpeting, the hook and loop fabric defining apertures generally aligned with the second and third apertures to permit insertion of the pegs.

10. An apparatus for use in putting a golf ball, the apparatus, comprising:
   - a first elongate tubular member having a first end and a second end, the second end having a first aperture extending therein, the first aperture having a size;
   - a second elongate tubular member, having a first end and a second end, the second member second end having a second member first aperture extending therein, the first aperture having a size; and
   - a unitary accordion member having a first end and a second end, each accordion member end having a protruding knuckle with a size slightly larger than the size of the first aperture in the first and second elongate members so that the knuckles are removably insertable into the first apertures of the second ends of the first and second elongate members to hold the second ends of the first and second elongate members in spaced relation to one another, the accordion member being collapsible and extendable to vary the distance between the second ends of the first and second elongate members.

11. The apparatus of claim 10 wherein the unitary accordion member comprises:

a tubular blow-molded member, the protruding knuckles being integrally formed with the tubular blow-molded member.

* * * * *